US006264452B1

(12) United States Patent
Sun et al.

(10) Patent No.: US 6,264,452 B1
(45) Date of Patent: Jul. 24, 2001

(54) REINFORCEMENT PIN FOR CHECK VALVE

(75) Inventors: Zili Sun; Gene Michael Fields, both of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/461,948

(22) Filed: Dec. 15, 1999

(51) Int. Cl.[7] ..... F01C 21/00

(52) U.S. Cl. ..... 418/270; 418/55.1; 137/527.4; 137/527.6; 137/527.8

(58) Field of Search ..... 418/270, 55.1; 137/527.4, 527.6, 527.8

(56) References Cited

U.S. PATENT DOCUMENTS

| | | | | |
|---|---|---|---|---|
| 386,462 | * | 7/1888 | Goll | 137/527.8 |
| 3,066,693 | * | 12/1962 | Taylor, Jr. | 137/527.4 |
| 3,366,137 | * | 1/1968 | Hansen | 137/527.8 |
| 4,223,697 | * | 9/1980 | Pendleton | 137/527.8 |
| 4,494,564 | * | 1/1985 | Lukacz | 137/527.8 |
| 4,607,661 | * | 8/1986 | Wessels et al. | 137/527.8 |
| 5,088,905 | * | 2/1992 | Beagle | 418/55.1 |
| 5,236,007 | * | 8/1993 | Scaramucci | 137/527.4 |
| 5,346,375 | * | 9/1994 | Akiyama et al. | 418/55.1 |
| 5,381,821 | * | 1/1995 | Muddiman | 137/527.4 |
| 5,693,090 | * | 12/1997 | Unsworth et al. | 137/527 |
| 6,123,528 | * | 9/2000 | Sun et al. | 418/55.1 |

FOREIGN PATENT DOCUMENTS

| | | | | |
|---|---|---|---|---|
| 3-149390 | * | 6/1991 | (JP) | 418/55.1 |
| 5-149269 | * | 6/1993 | (JP) | 418/55.1 |
| 6-066267 | * | 3/1994 | (JP) | 418/55.1 |

* cited by examiner

*Primary Examiner*—Thomas Denion
*Assistant Examiner*—Theresa Trien
(74) *Attorney, Agent, or Firm*—Carlson, Gaskey & Olds

(57) ABSTRACT

A scroll compressor has a check valve plate assembly with a reinforcing device to increase the strength of the check valve plate. The check valve plate is stamped from a relatively thin steel reed material. Notched areas are provided during stamping to enable the formation of rolled laterally spaced pins which provide an axis along which the check valve plate may pivot. The reinforcing device is in the form of a slot rolled pin, a spiral rolled pin, or a solid pin, fitted within a bore formed by the rolled laterally spaced pins of the check valve plate. The notched areas of the check valve plate are weakened due to the reduction of the local cross sectional area of the laterally spaced pins. Insertion of the reinforcing device significantly reduces the incidence of cracking that occurs at the notched areas of the check valve plate.

16 Claims, 3 Drawing Sheets

REINFORCEMENT PIN FOR CHECK VALVE

BACKGROUND OF THE INVENTION

This invention relates to an improved check valve plate assembly for use in scroll compressors which, while providing a desirable seal, is better adapted to withstand the stress imposed during the operation of a scroll compressor than the known valve plate assemblies.

Scroll compressors have become widely utilized in refrigerant compression applications. Since scroll compressors have greater efficiency than many types of compressors, they are desirable for many applications. However, scroll compressors also present many design challenges.

One challenge occurs at shutdown where a relatively large volume of compressed gas can move back through a discharge port and between the scroll compressor components. This can cause the scroll components to be driven in a reverse direction. To accommodate the issue of return gas, the scroll compressor is typically provided with a discharge valve which limits the amount of gas which moves between the scroll compressor components. It is desirable that the discharge valve forms a suitable seal with its respective valve seat. The discharge valve presented in the prior art provides such a seal.

One known discharge valve plate is stamped from relatively thin steel reed material, preferably having a generally uniform thickness of less than 0.03 inch and most preferably having a thickness of 0.015 inch. During operation, the prior art discharge valve pivots along an axis defined by pins that are formed by rolling laterally spaced ears that are integral to the valve plate and formed when the discharge valve plate is stamped or cut. This type check valve is disclosed in pending U.S. application Ser. No. 09/056,066, filed Apr. 6, 1998.

During the stamping procedure, notches are cut adjacent to the laterally spaced ears to enable them to be rolled into the pins that permit the valve plate to pivot. However, the notches cause local cross sectional area reduction on the formed pins and weaken their bending strength. Further, these notched areas of the valve plate undergo significant stress during scroll compressor operation and have been found to crack at these weaker areas.

SUMMARY OF THE INVENTION

In a disclosed embodiment of this invention, the formed pins of a reed valve plate for use on the discharge port of a scroll compressor are provided with a reinforcing device. Preferably, the pins are of the type rolled from the reed valve plate. The reinforcing device is preferably inserted into a bore in the center of the pin. The reinforcing device may be a slot rolled pin, a spiral rolled pin, or a solid pin.

Insertion of the single reinforcing device through the formed pins of the reed valve significantly improves the strength of the reed valve at the notched areas. Thus, the inventive reinforcing device provides a discharge valve plate assembly that is stronger than the prior art.

These and other features of the present invention can be best understood from the following specification and drawings, the following of which is a brief description.

DETAILED DESCRIPTION OF THE PREFERRED EMBODIMENT

Figure 1:
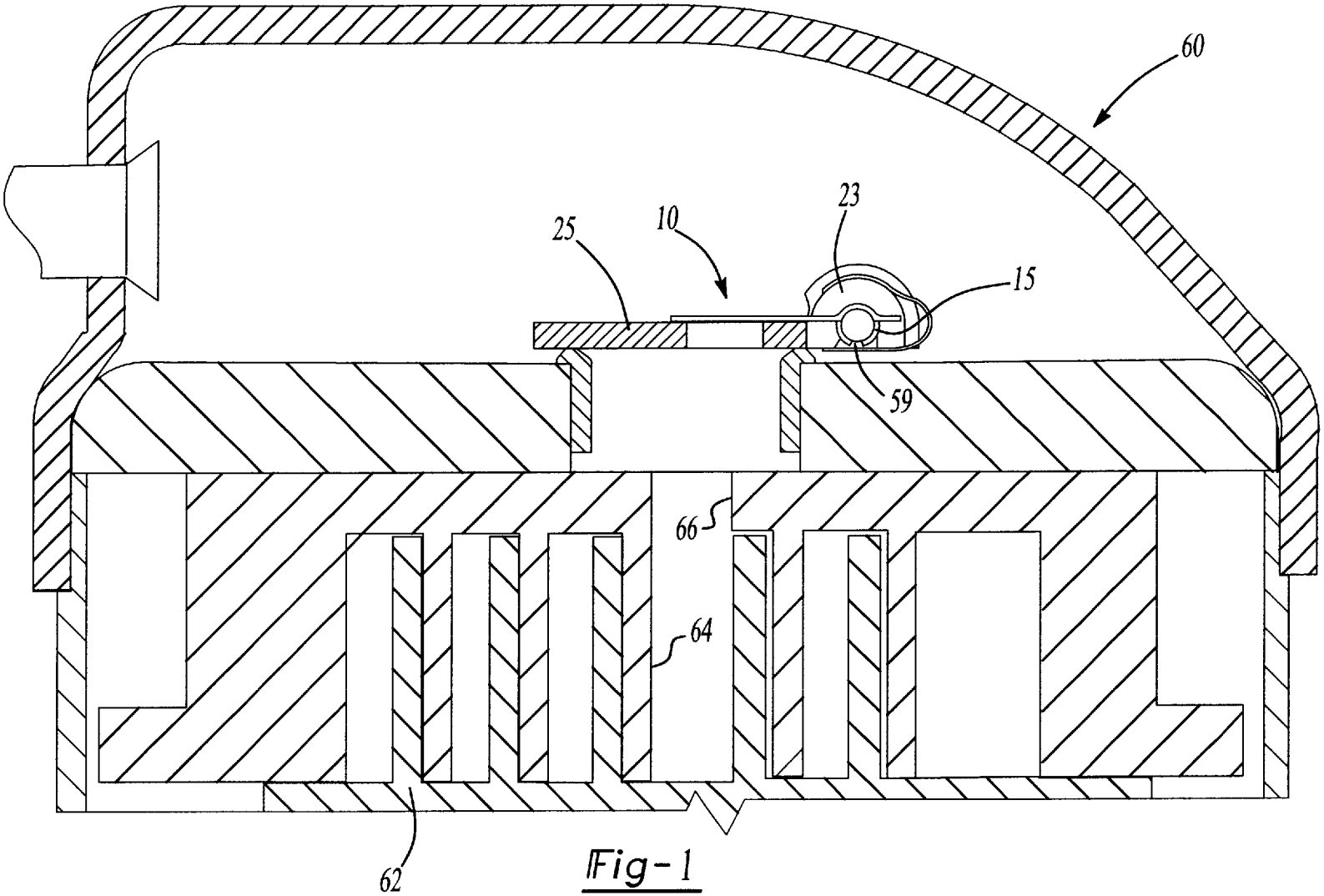
Fig-1 PRIOR ART
FIG. 1 shows a prior art discharge valve on a scroll compressor.
Figure 2:
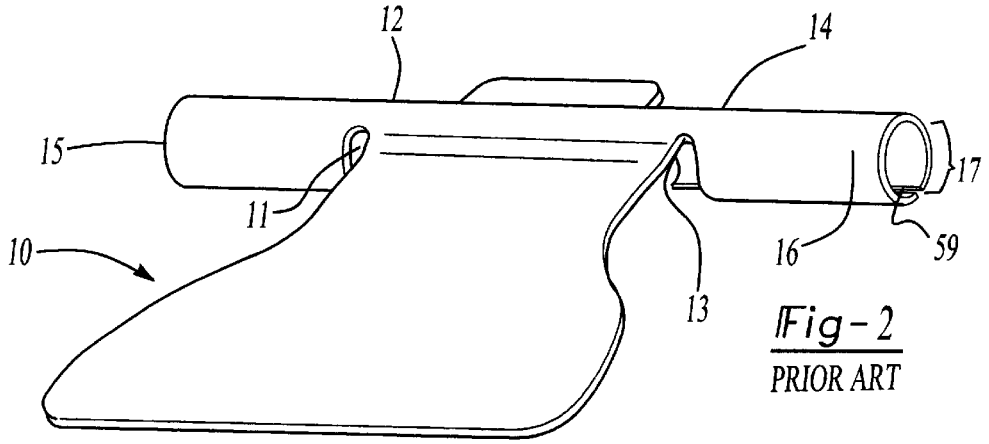
Fig-2 PRIOR ART
FIG. 2 shows the prior art reed valve plate.

A prior art valve plate 10 is illustrated in FIGS. 1 and 2. As shown, the plate 10 is mounted on a scroll compressor 60, having an orbiting scroll 62 and a non-orbiting scroll 64. As known, a port 66 extends through the base of scroll 64, and valve 10 selectively closes port 66. The valve plate is stamped or cut from a relatively thin steel reed valve material. Four notches 11, 12, 13, 14 are made during the stamping procedure to enable the formation of laterally spaced pins 15, 16 which have a bore 17. As shown, a slot 59 remains between the edges of the pins. Prior art valve plate 10 is pivotable along the axis of laterally spaced pins 15,16 within U-shaped portions 23 of a valve seat 25. During start up and shut down, the valve 10 is quickly driven between open and closed positions. The stresses during this movement are substantial. The bulk of these stresses are experienced by pins 15 and 16. Preferably, the plate is thin and preferably less than 0.03 inch thick.

Figure 3:
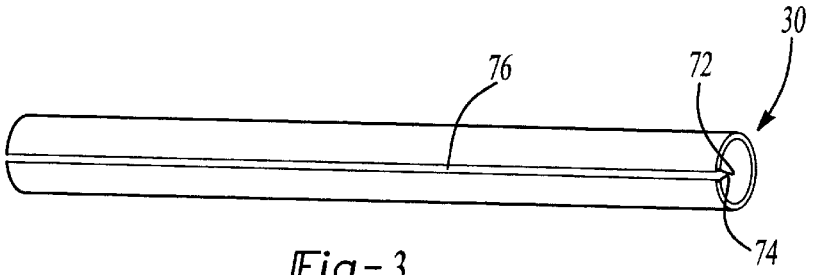
FIG. 3 shows a first embodiment of the inventive reinforcement device.
Figure 4:
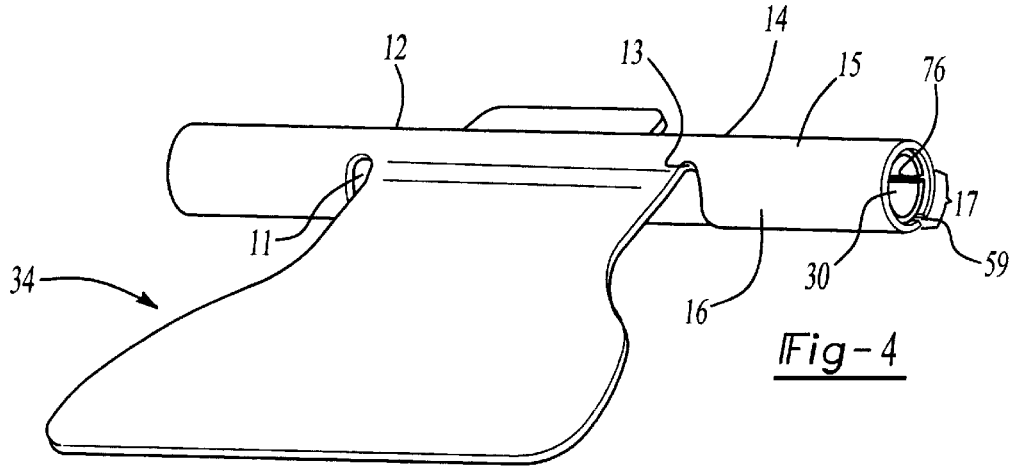
FIG. 4 shows the prior art valve plate with a first embodiment of the inventive reinforcement device.

FIG. 3 shows an inventive reinforcement device formed as a hollow slot rolled pin 30. Pin 30 is rolled from a sheet of metal and has facing edges 72, 74 spaced by a slot 76. As shown in FIG. 4 slot rolled pin 30 is inserted into inner bore 17 formed by laterally spaced pins 15,16 of a valve plate 34. Notably, the slots 76 and 59 are preferably circumferentially spaced. Thus, valve plate 34 is reinforced.

Figure 5:
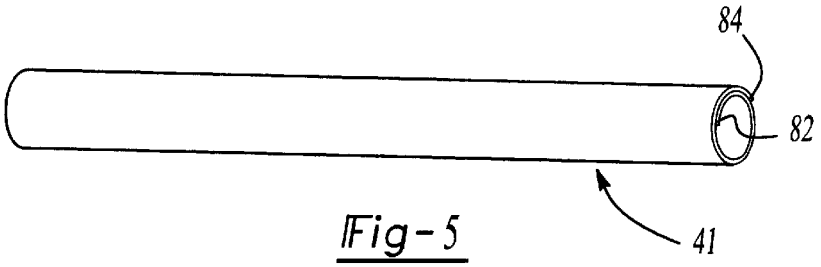
FIG. 5 shows a second embodiment of the inventive reinforcement device.
Figure 6:
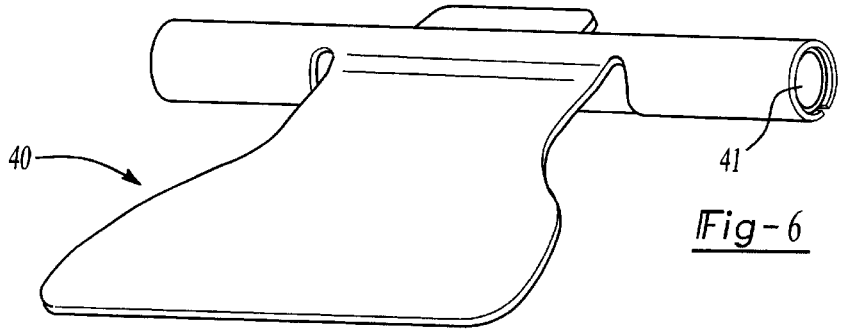
FIG. 6 shows the prior art valve plate with a second embodiment of the inventive reinforcement device.

FIG. 5 shows the inventive reinforcement device formed as a hollow spiral rolled pin 41. As shown, the ends 82 and 84 are rolled over each other, such that no slot exists. In FIG. 6, the reinforcement of valve plate 40 is provided by hollow spiral rolled pin 41.

Figure 7:
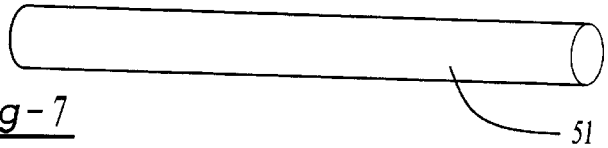
FIG. 7 shows a third embodiment of the inventive reinforcement device.
Figure 8:
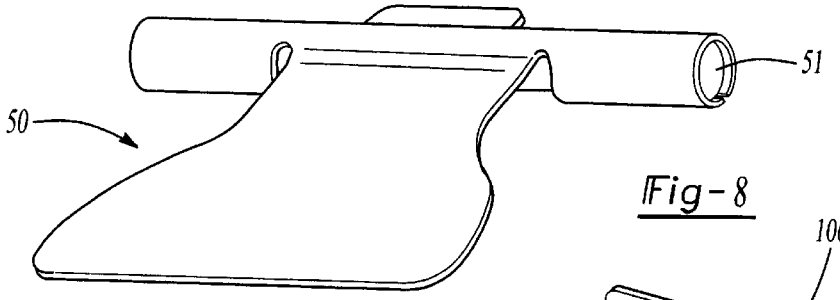
FIG. 8 shows the prior art valve plate with a third embodiment of the inventive reinforcement device.

FIG. 7 shows the inventive reinforcement device as a solid pin 51. In FIG. 8, valve plate 50 is reinforced using solid pin 51. Preferably, the pins 30, 41 and 51 have an outer diameter that is sized to provide a force fit in pins 15, 16.

Figure 9:
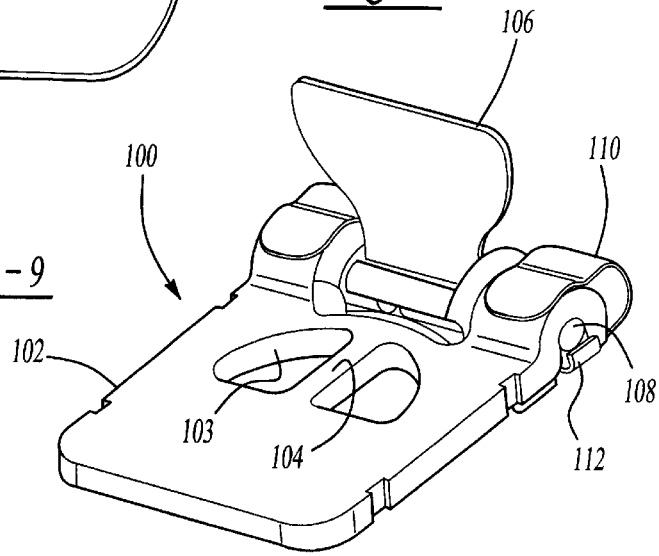
FIG. 9 shows another embodiment.

FIG. 9 shows another embodiment 100 wherein the valve seat 102 has the discharge bore 103 divided in half by a web 104. This web provides support, and further reduces the strength requirements for the reed valve 106. A reinforcement pin 108 is utilized as in the earlier embodiments. The clip 110 has side tabs 112, to prevent pin slip out laterally.

Preferred embodiments of this invention have been disclosed. However, a worker of ordinary skill in this art would recognize that certain modifications would come within the scope of this invention. For that reason, the following claims should be studied to determine the true scope and content of this invention.

What is claimed is:

1. A scroll compressor comprising:

first and second scroll members, and a discharge port;

a valve assembly having a valve seat with support surfaces, and positioned on said discharge port, and a thin flat valve plate having laterally spaced formed pins, wherein said valve plate is pivotable between an open and a closed position within said support surfaces and along an axis defined by said laterally spaced formed pins; and a device to reinforce the strength of said laterally spaced formed pins, said laterally spaced formed pins being received within said support surfaces, and said from pins rolled from a sheet of material which also forms said flat valve plate.

2. A compressor as recited in claim 1, wherein said laterally spaced formed pins have a bore, and said device to reinforce strength is seated within said bore.

3. A compressor as recited in claim 2, wherein said device to reinforce strength is a slot rolled pin.

4. A compressor as recited in claim 2, wherein said device to reinforce strength is a spiral rolled pin.

5. A compressor as recited in claim 2, wherein said device to reinforce strength is a solid pin.

6. A compressor as recited in claim 1, wherein said valve plate is less than 0.03 inch thick.

7. A compressor as recited in claim 6, wherein said valve plate has a generally constant thickness throughout its area.

8. A compressor as recited in claim 1, wherein a valve seat is associated with said valve plate, said valve seat having a discharge port extending there through, and said valve plate seating on said discharge port, and a web extending through said discharge port in said valve seat.

9. A compressor as recited in claim 1, wherein a valve clip holds said valve plate at a position wherein it is guided for pivotal movement, and said valve clip having lateral ears laterally outwardly of said pins.

10. A scroll compressor comprising:

first and second scroll members, and a discharge port;

a valve assembly having a valve seat with support surfaces, and positioned on said discharge port, and a thin flat valve plate having laterally spaced formed pins, wherein said valve plate is pivotable between an open and a closed position within said support surfaces and along an axis defined by said laterally spaced formed pins, said laterally spaced formed pins being received within said support surfaces;

a device to reinforce the strength of said laterally spaced formed pins; wherein said formed pins are rolled from a sheet of material which forms said flat valve plate; and said valve plate is less than 0.03 inch thick and has a generally constant thickness throughout its area.

11. A compressor as recited in claim 10, wherein said device to reinforce strength is a slot rolled pin.

12. A compressor as recited in claim 10, wherein said device to reinforce strength is a spiral rolled pin.

13. A compressor as recited in claim 10, wherein said device to reinforce strength is a solid pin.

14. A compressor as recited in claim 10, wherein said valve seat having a discharge port extending there through, and a central web dividing said discharge port into two portions.

15. A compressor as recited in claim 10, wherein a clip holds said valve plate on said valve seat, said clip having ears positioned laterally outwardly of said pins.

16. A compressor comprising:

first and second scroll members, and a discharge port extending through said second scroll member;

a valve assembly having a valve seat with support surfaces fixed above said discharge port, and a thin valve plate having laterally spaced formed pins pivotal in said valve seat, and a clip holding said valve plate on said valve seat, said valve seat having a web dividing said discharge port into two portions, and said clip having lateral guide ears spaced laterally outwardly of said pins.

* * * * *